US008627871B2

(12) United States Patent
Aquilina

(10) Patent No.: US 8,627,871 B2
(45) Date of Patent: Jan. 14, 2014

(54) SECTIONAL OVERHEAD DOOR ACTUATORS

(76) Inventor: Anthony George Aquilina, Milton (CA)

( * ) Notice: Subject to any disclaimer, the term of this patent is extended or adjusted under 35 U.S.C. 154(b) by 19 days.

(21) Appl. No.: 13/324,083

(22) Filed: Dec. 13, 2011

(65) Prior Publication Data

US 2013/0146235 A1 Jun. 13, 2013

(51) Int. Cl.
*E05F 15/08* (2006.01)

(52) U.S. Cl.
USPC ..... 160/188; 160/201

(58) Field of Classification Search
USPC ..... 160/188, 311, 193; 49/360, 199
See application file for complete search history.

(56) References Cited

U.S. PATENT DOCUMENTS

| | | | | |
|---|---|---|---|---|
| 2,625,390 | A * | 1/1953 | McFadden | 160/188 |
| 3,221,610 | A * | 12/1965 | King et al. | 92/24 |
| 3,231,259 | A * | 1/1966 | Bobrowski et al. | 49/360 |
| 4,102,382 | A | 7/1978 | Vesbach | |
| 4,417,418 | A | 11/1983 | Warning | |
| 4,519,297 | A * | 5/1985 | Lipinski | 92/88 |
| 4,891,908 | A | 1/1990 | Aquilina | |
| 4,984,387 | A * | 1/1991 | Wheatland | 49/362 |
| 5,040,332 | A | 8/1991 | Aquilina | |
| 5,280,818 | A | 1/1994 | Ubelhart | |
| 5,544,691 | A | 8/1996 | Wandio | |
| 5,806,245 | A | 9/1998 | Satrom | |
| 6,336,393 | B1 | 1/2002 | LeMire et al. | |
| 7,537,042 | B2 | 5/2009 | Altimore | |
| 7,744,035 | B2 | 6/2010 | Saint-Jalmes et al. | |

FOREIGN PATENT DOCUMENTS

| | | |
|---|---|---|
| GB | 2361263 | 10/2001 |
| WO | WO 03/076749 A1 | 9/2003 |

* cited by examiner

*Primary Examiner* — Blair M. Johnson
(74) *Attorney, Agent, or Firm* — Fay Sharpe LLP

(57) ABSTRACT

The present disclosure pertains to a sliding overhead door operator system for an overhead door not employing a counterbalance mechanism. The operator system comprises an overhead door including first and second side edges, the door includes a plurality of hingedly connected longitudinally extending panels. Additionally, a first rodless cylinder is located adjacent the first side edge of the door and a second rodless cylinder is located adjacent the second side edge of the door. Each of the first and second cylinders includes a carriage. First and second bracket assemblies are provided such that each assembly includes a first portion secured to a respective carriage of one of the first and second rodless cylinders and a second portion secured to one of the plurality of panels. A controller is adapted to actuate the first and second rodless cylinders to move the door up and down.

18 Claims, 8 Drawing Sheets

SECTIONAL OVERHEAD DOOR ACTUATORS

BACKGROUND

The present disclosure relates to sectional overhead doors such as garage doors and the like and specifically to operating systems and methods for such doors. It finds particular application in conjunction with a sliding sectional overhead door which utilizes a pair of rodless fluid cylinders for mechanically opening and closing a door without the assistance of a counterbalance mechanism, and will be described with particular reference thereto. However, it is to be appreciated that the present exemplary embodiment is also amenable to other like applications.

Overhead doors are known to include a plurality of door panels that are hingedly connected to each other and slidably mounted to a track assembly positioned adjacent a building opening. Overhead garage doors generally include a counterbalance mechanism to assist in the operation of the door. A common counterbalance mechanism includes a torsion spring positioned about an axis for storing energy during door operation so that energy can be extracted or stored during the opening or closing of the door. Generally, during door opening, most of the energy for lifting the door is derived from the energy stored in the spring or counterweight mechanism so that the energy required to open the door is reduced.

Conventional overhead doors of this nature are actuated by a pulley assembly having a cable which is wound around a drum that is axially driven by the torsion spring with the drum being rotated by a chain driven sprocket. The chain is generally driven by an electric motor, pneumatic cylinder or some other automatic mechanism. However, it would be desirable to utilize a garage door operator mechanism with a reduced number of moving parts as such a mechanism requires less maintenance.

Also, when such doors go through a high volume of cycles, such as in a car wash application, the chains, torsion springs, sprockets, electrical motors, and the like wear out at a fairly rapid rate and result in frequent breakdowns of the door opening mechanism. Malfunctions of the door operating mechanism can sometimes also lead to damage to the upper portion of the door which can be fairly expensive to repair. Moreover, corrosive chemicals and humidity may, over time, damage the moving parts of the door assembly further causing failure or maintenance issues.

There are many other types of garage door operating systems such as standard lift, vertical lift and low headroom operating systems having similar features that employ counterbalance mechanisms and are at an increased risk of breakdown, hazard to personnel, and damage to the door when used in a humid environment or in an environment that experiences a high volume of operations. Therefore, there remains a need for a sectional overhead door operating system which does not employ a counterweight or counterbalance mechanism.

BRIEF DESCRIPTION

In one embodiment the present disclosure pertains to a sliding overhead door operator system for an overhead door not employing a counterbalance mechanism. The operator system comprises an overhead door including first and second side edges, the door includes a plurality of hingedly connected longitudinally extending panels. Additionally, a first rodless cylinder is located adjacent the first side edge of the door and a second rodless cylinder is located adjacent the second side edge of the door. Each of the first and second cylinders includes a carriage. First and second bracket assemblies are provided such that each assembly includes a first portion secured to a respective carriage of one of the first and second rodless cylinders and a second portion secured to one of the plurality of panels. A controller is adapted to actuate the first and second rodless cylinders to move the door up and down.

In another embodiment of the present disclosure, provided is a sectional overhead door system that does not employ a counter balance assembly. The overhead door system includes a track assembly located adjacent to a building opening, a door including a plurality of hingedly connected sectional panels moveably mounted to the track assembly and a pair of rodless cylinder operators connected to the door. Each rodless cylinder operator is disposed adjacent a respective side edge of the door and includes a longitudinally extending body, a rodless piston adapted for linear translation within the body, and a carriage connected to the piston and adapted for linear translation externally along a length of the body. Also, a pair of arm assemblies such that each arm assembly is adapted to connect a respective one of the pair of rodless cylinder operators to a first panel of the door. A controller is adapted to operate the rodless cylinder operators to move the door between a first position and a second position in relation to the track assembly.

In still another embodiment, a method for operating a sectional overhead door system without employing a counterbalance mechanism is provided. The method includes providing a sectional overhead door, a first rodless cylinder operator and a second rodless cylinder operator. The first rodless cylinder operator being located adjacent to a first track to which a first side of the door is movably mounted and the second rodless cylinder operator being located adjacent to a second track to which a second side of the door is movably mounted. A first piston and a second piston are urged to move within the respective first and second rodless cylinder operators and the overhead door slides along the first and second tracks such that the door is moved between an open position and a closed position.

BRIEF DESCRIPTION OF THE DRAWINGS

The present disclosure may take form in certain parts and arrangements of parts, several embodiments of which will be described in detail in this specification and illustrated in the accompanying drawings which form a part hereof and wherein.

DETAILED DESCRIPTION

It is to be understood that the detailed figures are for purposes of illustrating exemplary embodiments of the present disclosure only and are not intended to be limiting. Additionally, it will be appreciated that the drawings are not to scale and that portions of certain elements may be exaggerated for the purpose of clarity and ease of illustration.

Figure 1:
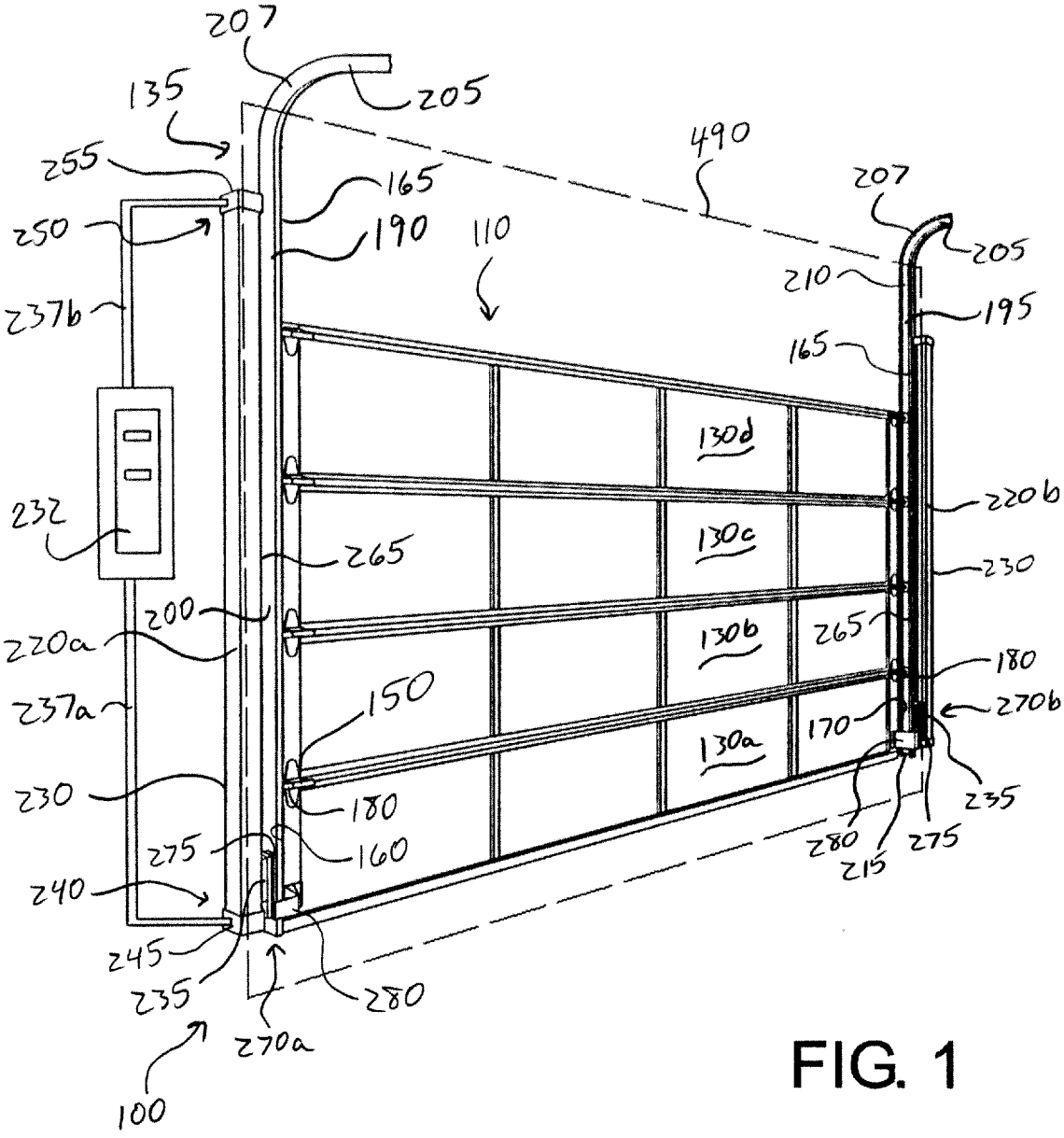
FIG. 1 is a schematic perspective view of an overhead door and door operator assembly according to one embodiment of the present disclosure.
Figure 2:
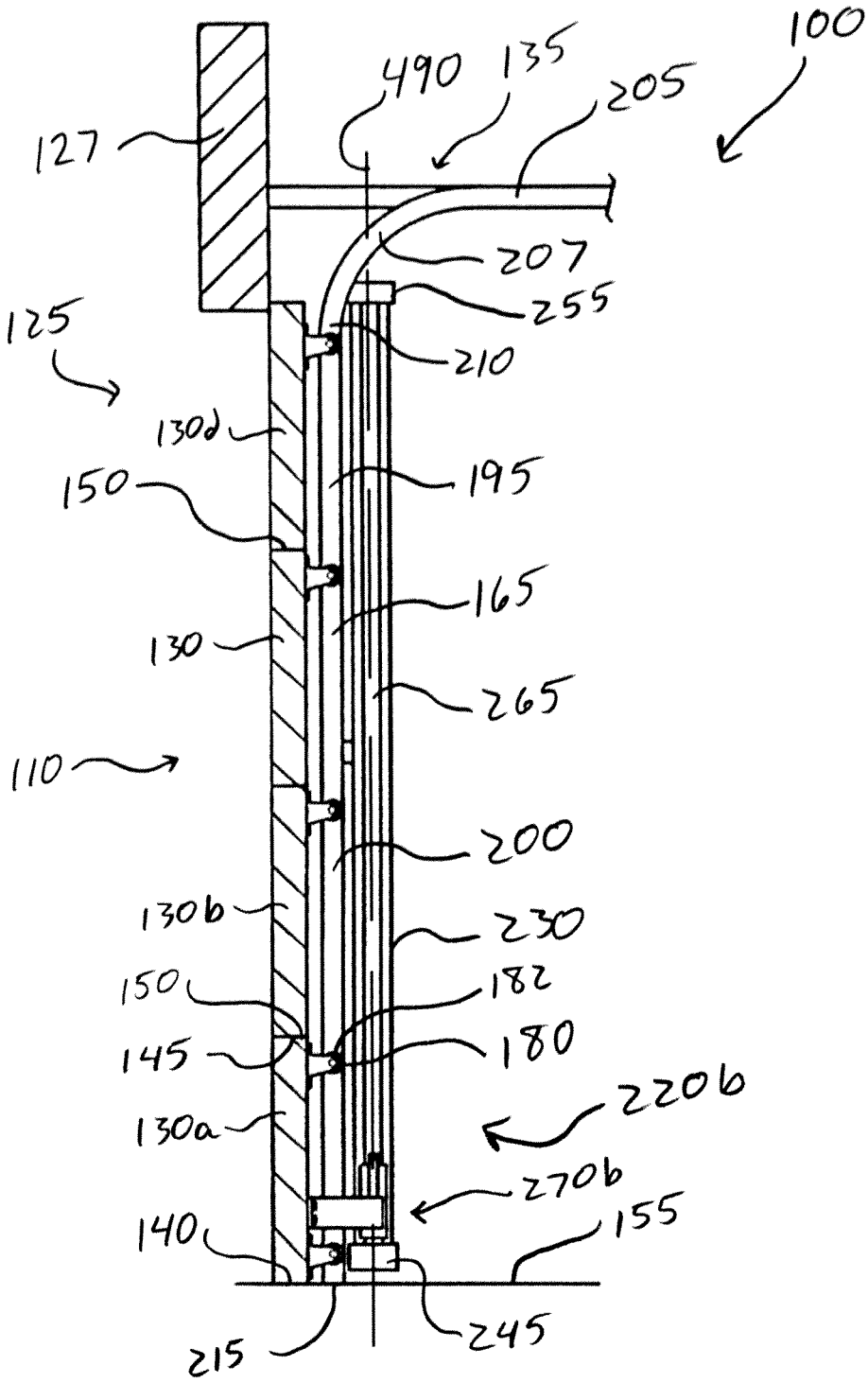
FIG. 2 is a cross-sectional view of the overhead door and the door operator assembly of FIG. 1.

In accordance with the present disclosure, FIGS. 1 and 2 illustrate a door operator system 100 for a sectional overhead door 110, such as a garage door opener (operator), that is adapted to move the door 110 between a closed position and an open position in relation to an opening 125 (See FIG. 2) of a building 127. While the door operator system 100 is designed for and will hereinafter be described in connection with a sectional overhead sliding door 110, it should be appreciated that the disclosure may be adapted for use in many other door environments.

The door 110 includes a plurality of longitudinally extending sectional panels 130*a*-130*d* that are pivotally connected to one another by a plurality of hinges 150 which allow for pivotal movement of the panels as the door is slidably translated along a track assembly 135. The size of each panel 130*a*-130*b* and the number of panels are determined by the dimensions of the opening 125 in which the door 110 is to be installed. This disclosure does not limit the number of panels that are included in the door 110 or the size of each panel. In one embodiment, the opening 125 and, consequently, the door 110 are a generally rectangular. Each sectional panel 130*a*-130*d* can also have a generally rectangular shape that includes a bottom side 140 and an oppositely disposed top side 145. Each of the panels 130*a*-130*d* can include a similar height and a similar width such that the width is greater than the height or, alternatively, the height is greater than the width. Each panel can be made with conventional garage door material such as plywood, fiberglass, aluminum and the like but can also be made from a transparent material such as glass or a translucent material such as plastic depending on the needs of the building 127.

The bottom or first panel 130*a* is located at the base of the door 110 such that the bottom side 140 is adapted to abut a floor 155 of the building 127 as the door 110 is oriented in the closed position. As illustrated in FIG. 1, hinges 150 connect the top side of one panel 130*a* to the bottom side of the next panel 130*b*.

The door 110 includes a first side edge 160 and an oppositely disposed second side edge 170. In one embodiment, the first side edge 160 is oriented generally parallel to the second side edge 170 such that the first and second side edges 160, 170 are generally normal to the floor 155. Mounted to the door 110 are a plurality of roller shafts 180 that extend outwardly from the first and second side edges 160, 170 and are adapted to hold rollers 182 which engage in the track assembly 135. In one embodiment, the shafts 180 are mounted to the hinges 150. However, the roller shafts 180 can also extend outwardly from the door 110 in offset alignment from the hinges 150. (See FIG. 2).

The track assembly 135 includes a first track 190 and a second track 195 such that each track is adapted to receive the rollers 182 within a respective channel 165. This configuration is adapted to allow sliding movement of the door 110 along the profile of the track assembly 135 as the door is moved between the closed position and the open position. The first track 190 is disposed along the first side edge 160 of the door 110 and includes channel 165 that is adapted to receive the plurality of rollers 182 extending therefrom. Similarly, the second track 195 is disposed along the second side edge 170 of the door 110 and includes channel 165 that is adapted to receive the plurality of rollers 182 extending therefrom. The track assembly 135 is provided adjacent to the opening 125 of the building 127 such that the door is adapted to slide up and down while the rollers 182 are operatively engaged to the channels 165 of the first and second tracks 190, 195.

In one embodiment, both the first and second tracks 190, 195 of the track assembly 135 include a first portion 200 that is oriented generally parallel to and spaced from the opening 125 and a second portion 205 that is oriented generally transverse to the first portion 200. However, the second portion 205 can be oriented along any desired angle relative to the first portion 200. The first portion 200 includes a top end 210 and the bottom end 215 such that the second portion 205 of the track assembly 135 is attached to the top end 210 of the first portion 200. The bottom end 215 of the first and second tracks 190, 195 can mount to the building 127. Similarly, the second portion 205 can be attached to the building 127. In one embodiment, the second portion 205 of the track assembly 135 includes a portion of track that has a non-linear or curved profile 207 that is connected to the top end 210 of the first portion 200. Generally, the first portion 200 can have a length that is greater than a height of the opening 125.

In one embodiment, the door operator system 100 is adapted to operate the door 110 in relation to the opening 125 within building 127, namely, that the opening 125 is configured in a generally rectangular configuration such that an opening height is greater than an opening width. In another embodiment, the opening 125 is configured in a generally rectangular configuration such that the opening height is less than the opening width. Put another way, the sectional door could be wider than it is tall or taller than it is wide. It should be appreciated that this disclosure does not limit the size and shape of the door which is actuated by the door operator system 100.

The operator system 100 includes a first and a second rodless cylinder operator 220*a*, 220*b*. The first rodless cylinder operator 220*a* is provided adjacent the first portion 200 of the first track 190 and is mounted to the track 190 adjacent the first side edge 160. The second rodless cylinder operator 220*b* is provided adjacent the first portion 200 of the second track 195 and is mounted to the track 195 adjacent the second side edge 170. These can be identical and thus only the first operator 220*a* will be discussed in detail, it being appreciated that the second operator 220*b* can have the same components. Each cylinder operator can include an elongated body 230 (See FIGS. 7 and 8) having a generally rectangular cross-sectional shape with an internal bore section 223 that is adapted to receive a piston 243 and that allows reciprocal longitudinal translation of the piston 243 therein. In one embodiment, the rodless cylinders can be made of conventional materials such as an aluminum extrusion with a heavy coat of anodizing.

A controller 232 is provided to actuate the first and second rodless cylinders 220*a*, 220*b* to urge the piston 243 to move between a first position 225 and a second position 227 of the elongated body 230. The rodless cylinders can be fluid operated and actuated to move the door up and down.

A first end 240 of each rodless cylinder operator 220*a*, 220*b* is closed by a first end member 245 and a second and opposite end 250 of each rodless cylinder operator is closed by a second end member 255. Suitable fasteners secure the first and second end members 245, 255 to the elongated body 230. A suitable seal is provided to prevent pressurized gas or pressurized fluid from leaking therethrough. The controller 232 can be connected to fluid lines 237*a* and 237*b* which are provided in communication with each rodless cylinder 220*a*, 220*b*. In one embodiment, the fluid line 237*a* communicates with the rodless cylinders at the first end members 245 and fluid line 237*b* communicates with the rodless cylinders at the second end members 255. (See FIG. 1).

Figure 7:
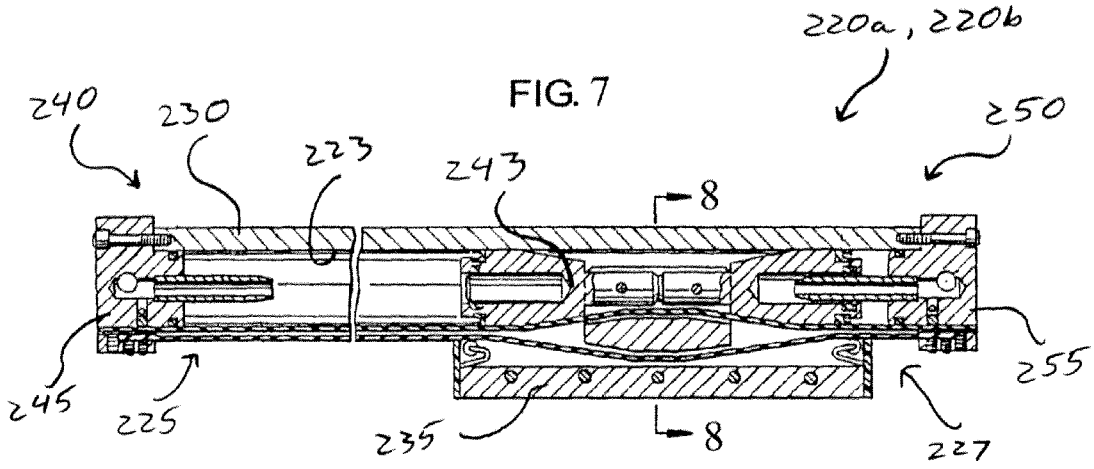
FIG. 7 is an enlarged cross sectional view, with a portion broken away, of an elongated body of the operator assembly of FIG. 1.
Figure 8:
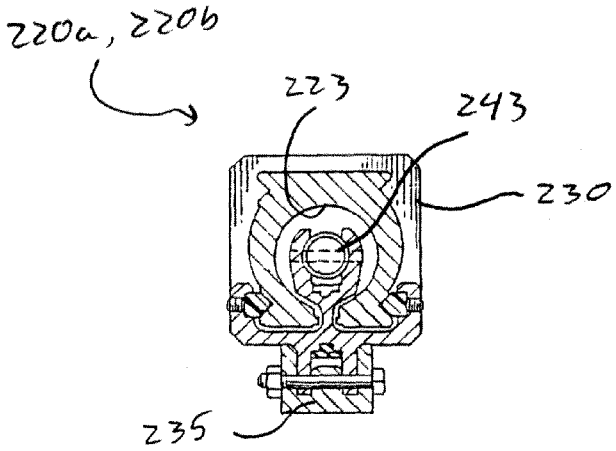
FIG. 8 is an end elevation view in cross section of the elongated body of FIG. 7.

A carriage 235 is connected to the piston 243 and is adapted for linear translation externally along a length of the elongated body 230. In one embodiment, as shown in FIGS. 7 and 8, the carriage 235 translates along an inwardly facing side 265 of the elongated body 230 that is adapted to face the door 110. The length of linear translation 260 of the carriage 235 extends between the first end member 245 and the second end member 255. In one embodiment, as the piston 243 is positioned at or adjacent the first position 225, the carriage is positioned in close proximity to the first end member 245. Similarly, as the piston 243 is positioned at or adjacent the second position 227, the carriage is positioned in close proximity to the second end member 250.

A first and a second bracket assembly 270*a*, 270*b* are provided to connect the first and second rodless cylinder operators 220*a*, 220*b* to the door 110. In one embodiment, the first bracket assembly 270*a* is a mirror image of the second bracket assembly 270*b* such that each bracket assembly 270*a*, 270*b* includes a first portion secured to the carriage 235 on the elongated body 230 and a second portion secured to the door 110. The first portion can be a first link 275 and the second portion can be a bracket member 280. The bracket assemblies can be a powder coated metal or can be a stainless steel material for structural strength and to prevent corrosion. Notably, the first bracket assembly 270*a* and the second bracket assembly 270*b* are connected to the bottom panel 130*a* of the door 110.

Figure 3:
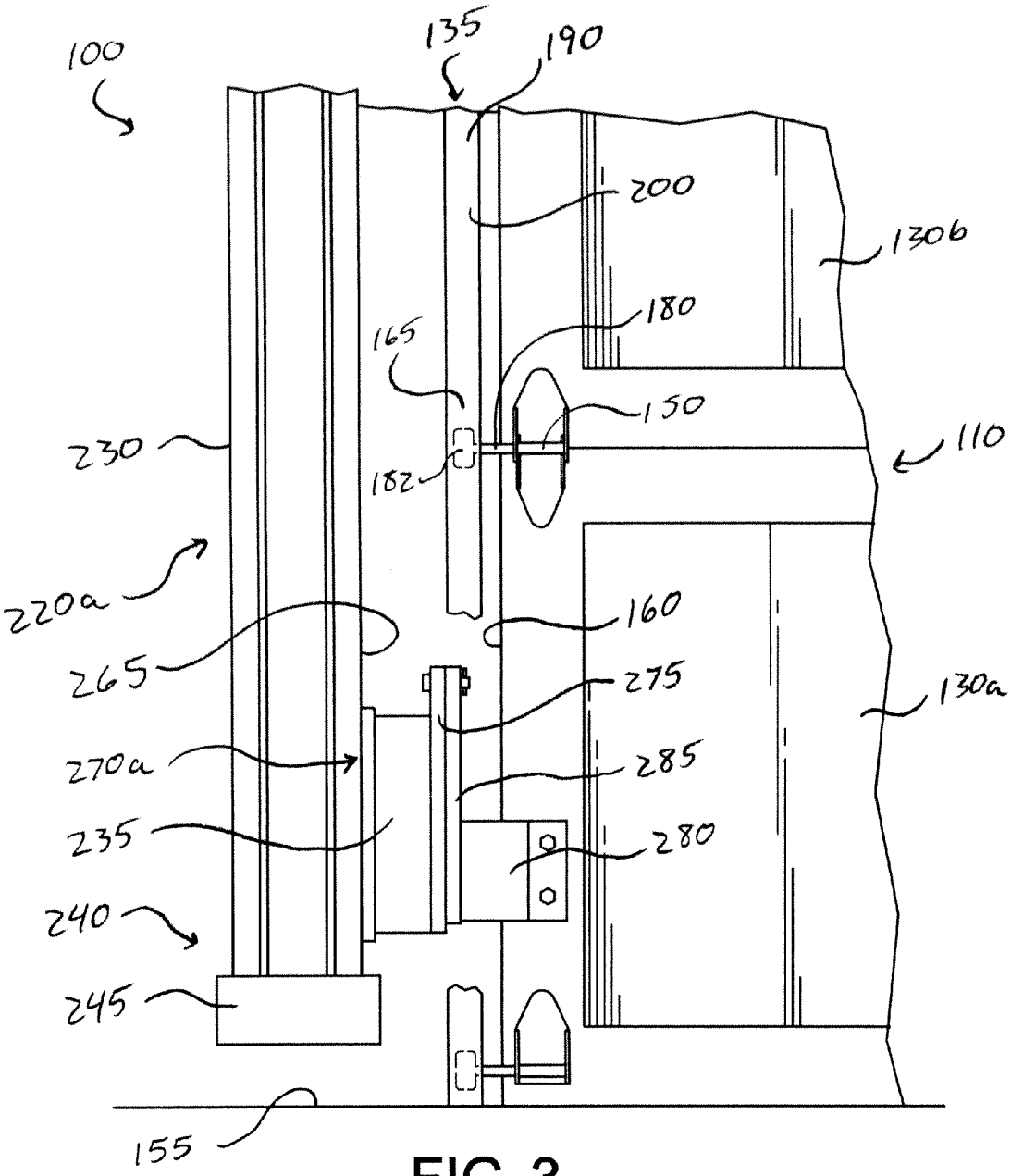
FIG. 3 is an enlarged fragmentary front elevational view of FIG. 1 illustrating the connection between the overhead door and the door operator assembly according to the present disclosure.

In the embodiment illustrated in FIGS. 1, 2 and 3, the second portion or bracket member 280 of the first bracket assembly 270*a* is secured to the first panel 130*a* adjacent a first side edge 160 of the door 110 and the bracket member 280 of the second bracket assembly 270*a* is secured to the first panel 130*a* adjacent a second side edge 170 of the door 110. By connecting the bracket members to the first panel, the door experiences less stress than if the bracket members or some other linkage mechanism, were to be connected to the door at another location, for example, adjacent a top portion of the door 110. Notably, in FIG. 3, the door 110 is in the closed position such that the carriage 235 and the first bracket assembly 270*a* are located in a position adjacent the first end member 245 of the elongated body 230 of the first rodless cylinder operator 220*a*.

Figure 9:
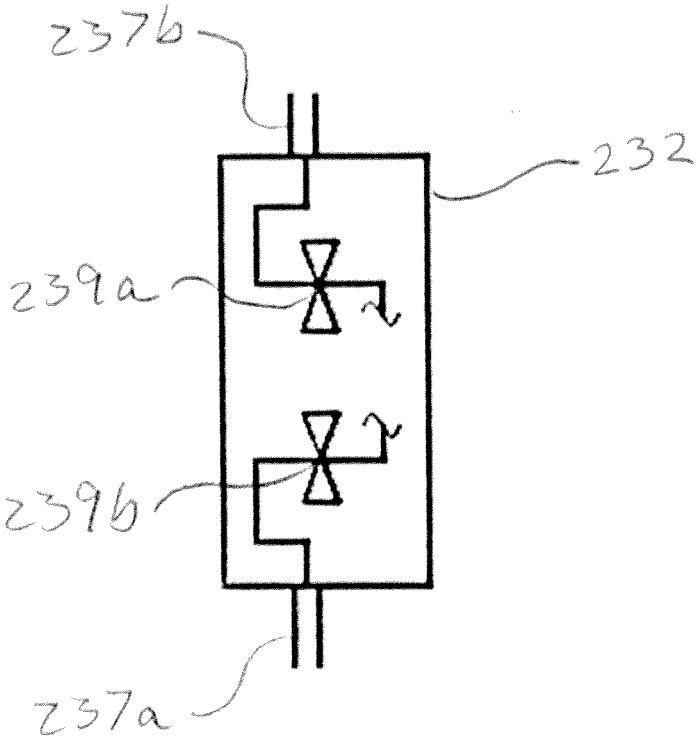
FIG. 9 is a schematic view of a controller of the operator assembly of FIG. 1.

The controller 232 as illustrated in FIGS. 1 and 9, can operate the door without employing a separate counterbalance mechanism. When prompted by a user, the controller 232 moves the piston 243, such as via a pressurized fluid (pneumatic or hydraulic) conducted through the fluid line 237*a*. As fluid is introduced at the first end member 245 of the first and second rodless cylinder operators 220*a*, 220*b*, some fluid is evacuated from the second portion or second end member 250 of the first and second rodless cylinder operators 220*a*, 220*b* and through the fluid line 237*b*. A pressure relief valve 239*a*, situated in the controller 232, regulates the pressure of the fluid exiting via line 237*b*. The pistons 243 are urged to move in a first direction thereby sliding the overhead door 110 in the first direction along the track assembly 135 away from the closed position and towards the open position. Here, the rodless cylinder operators 220*a*, 220*b* and bracket assemblies act to push up the door and pivots according to the contour of the track assemblies 135, 165 and 190 against the force of gravity.

Similarly, when prompted by a user, the controller 232 can introduce a pressurized fluid, through the fluid lines 237*b* to the second portion or second end member 250 of the first and second rodless cylinder operators 220*a*, 220*b* to initiate closing. Closing can be initiated by relying on the weight of the door acting on the rodless cylinders whereby regulated minimal exhaust is maintained at the second end member 250, by means of a conventional pressure relief valve 239*b* situated in the controller 232. What is more important is that pressurized fluid is maintained at the same velocity as it is evacuated from the first portion or first end member 245 of the first and second rodless cylinder operators 220*a*, 220*b* through the fluid lines 237*a*. Thus the pistons 243 are urged to move in a second direction thereby sliding the overhead door 110 in the second direction along the track assembly 135 away from the open position and towards the closed position, but in a controlled manner.

In a simpler embodiment, when prompted by the user to close the door 110, the controller 232 can regulate the amount of pressurized fluid that is evacuated from the first end member 245. The pistons 243 are urged to move in the second direction by the force of gravity acting on the door 110 such that the pistons 243 compress the fluid within the elongated body 230 thereby assisting the evacuation of the fluid from the first end members 245 of the first and second rodless cylinder operators. The controller 232 can regulate the evacuation of fluid by the use of conventional control valves (not shown) positioned in communication with the fluid lines 237*a* and the first end members 245. This embodiment can assist in regulating the speed of the door 110 as gravity urges the door from the open position to the closed position.

In one embodiment, the controller 232 supplies pressurized fluid to the rodless cylinder operators 220*a*, 220*b* to both open and close the door. The pressurized fluid is maintained at generally similar pressure levels as the door 110 is opened and as the door 110 is closed. The speed of door movement and the force exerted on the door by the rodless cylinder operators, or similar types of actuators, are regulated by means of the at least one pressure relief valve 239*a*, 239*b*. When the door 110 is opened, the pressure relief valve 239*a* is configured to evacuate more exhaust pressurized fluid, causing a greater fluid force through the pressure relief valve 239*a* and fluid lines 237*a* than when closing the door 110. In contrast, when the door 110 is closed, the pressure relief valve 239*b* is configured to evacuate less exhaust pressurized fluid, causing less fluid force through the pressure relief valve 239*b* and fluid lines 237*b* than when opening the door 110.

Figure 4:
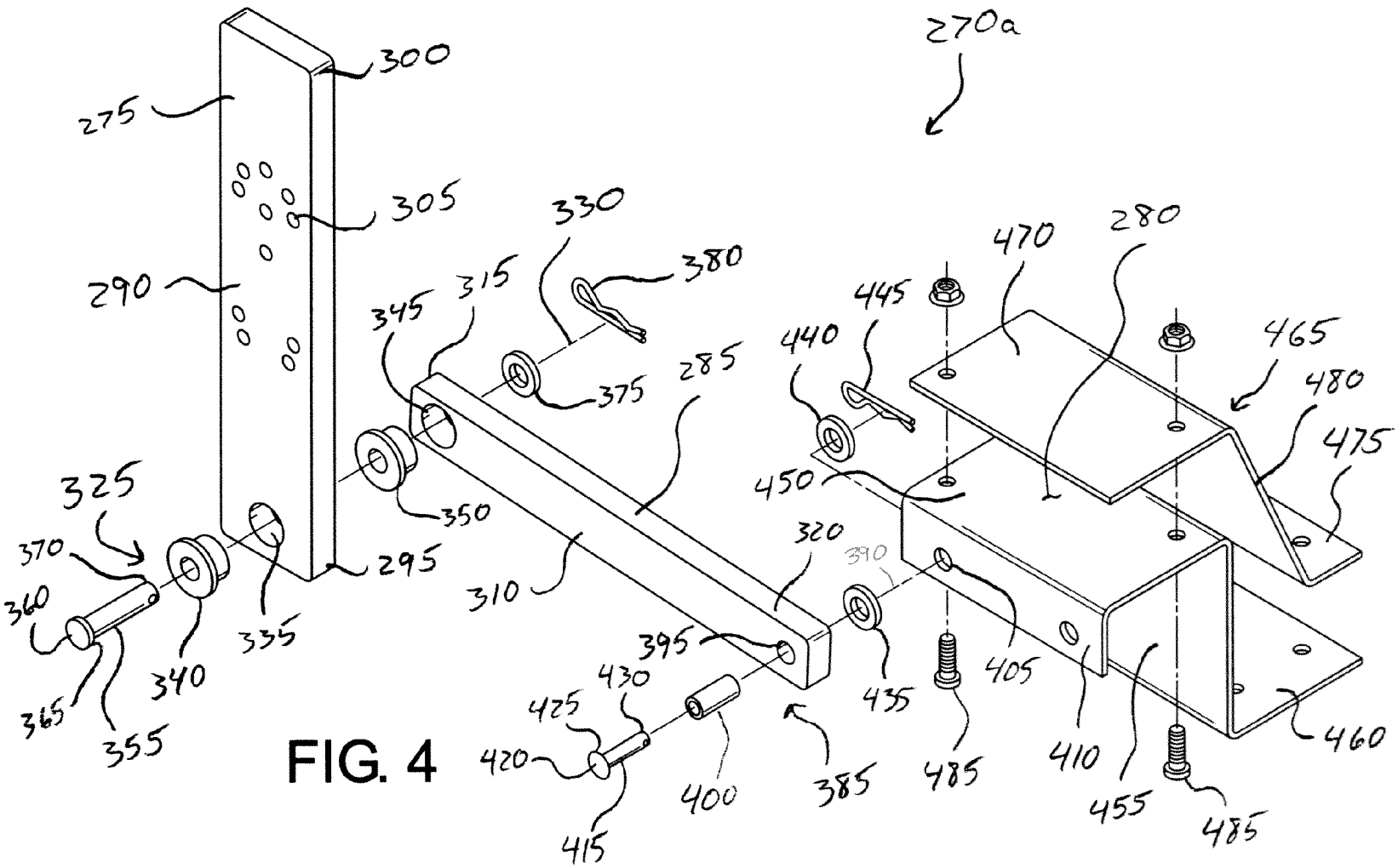
FIG. 4 is an enlarged exploded perspective view of a bracket assembly of the door operator assembly of FIG. 3.

An exploded view of the components of the bracket assembly 270*a* is illustrated in FIG. 4. The bracket assemblies 270*a*, 270*b* can include the same components and only the first assembly 270*a* will be discussed in detail. The assembly 270*a* includes a first link 275 that is adapted to be secured to the carriage 235, a second link 285 that is pivotally attached to the first link 275 and a bracket member 280 that is pivotally attached the second link 285 and adapted to be secured to the door 110. The first link 275 can be a generally rigid mounting plate 290 having a first end 295 and an oppositely disposed second end 300. The mounting plate 290 includes a plurality of apertures 305 that are sized to receive a plurality of conventional fasteners (not shown) to secure the first link 275 to the carriage 235. The second link 285 includes a generally rigid body 310 having a first end 315 an oppositely disposed second end 320.

The first link 275 and the second link 285 are pivotally connected at a first pivot joint 325. The first pivot joint 325 allows the second link 285 to pivot relative to the first link 275 about a first axis 330 extending through the first end 295 of the first link 275 and the first end 315 of the second link 285. The first pivot joint 325 includes a first pivot hole 335 in the rigid mounting plate 290 of the first link 275 that is adapted to receive a first bushing 340 and a second pivot hole 345 located in the rigid body 310 of the second link 285 that is adapted to receive a second bushing 350. The first and second bushings 340, 350 are similarly oriented and are configured to rotably support a first pivot pin 355 axially inserted therethrough. The first pivot pin 355 has a distal portion 360 with a radial edge 365 that abuts the first bushing 340 and an oppositely disposed proximal portion 370 that is axially inserted through the first and second bushings 340, 350 of the pivot joint 275. A first washer 375 and a first cotter pin 380 are axially positioned along the proximal portion 370 to rotably secure the first pivot pin 355 to the first and second links 275, 285.

The second link 285 and the bracket member 280 are pivotally connected at a second pivot joint 385. The second pivot joint 385 allows the second link 285 and the bracket member 280 to pivot about a second axis 390 located through the second end 320 of the second link 285 and a base portion 395 of the bracket member 280. The second pivot joint 385 includes a hole 395 at the second end 320 of the second link 285 that is adapted to receive a bushing member 400 and a hole 405 located in the base portion 410 of the bracket member 280 that is also adapted to receive the bushing member 400. The bushing member 400 rotably supports a second pivot pin 415 that is axially inserted therethrough. The second pivot pin 415 has a distal portion 420 with a radial edge 425 that abuts the bushing member 400 and an oppositely disposed proximal portion 430 that is axially inserted through the second pivot joint 385. A second washer 435 is provided between the second link 285 and the bracket member 280 along the second pivot pin 415. A third washer 440 and second cotter pin 445 are axially positioned along the proximal portion 430 to secure the second pivot pin 415 to the second link 275 and bracket member 280. It is noted that two apertures 405 can be provided in the base portion 410 so that the linkage can be adjusted as may be necessary. The fasteners, washers, pins and bushing members can be made from a stainless steel material or a bronze material to provide for a long life against corrosion and structural failure.

In one embodiment, the bracket member 280 can include a first plate comprising the base portion 410, a support portion 450 that is oriented generally perpendicular to the base portion 410, a flange 455 that extends from the support portion 450 and is oriented generally parallel to the base portion 410 and an attachment portion 460 that extends from the flange 455 and is configured to be securely attached to the door 110. In one embodiment, the base portion 410, support portion 450, flange 455 and attachment portion 460 are made from a sheet of a continuous rigid material such as conventional metal. The bracket member 280 can also include a second plate 465 having a first flange 470 aligned with the support portion 450 and a second flange 475 aligned with the attachment portion 460 such that a base portion 480 is located between the first flange 470 and the second flange 475. The first flange 470 is attached to the support portion 450 and/or the attachment portion 460 by threaded fasteners 485.

Figure 6:
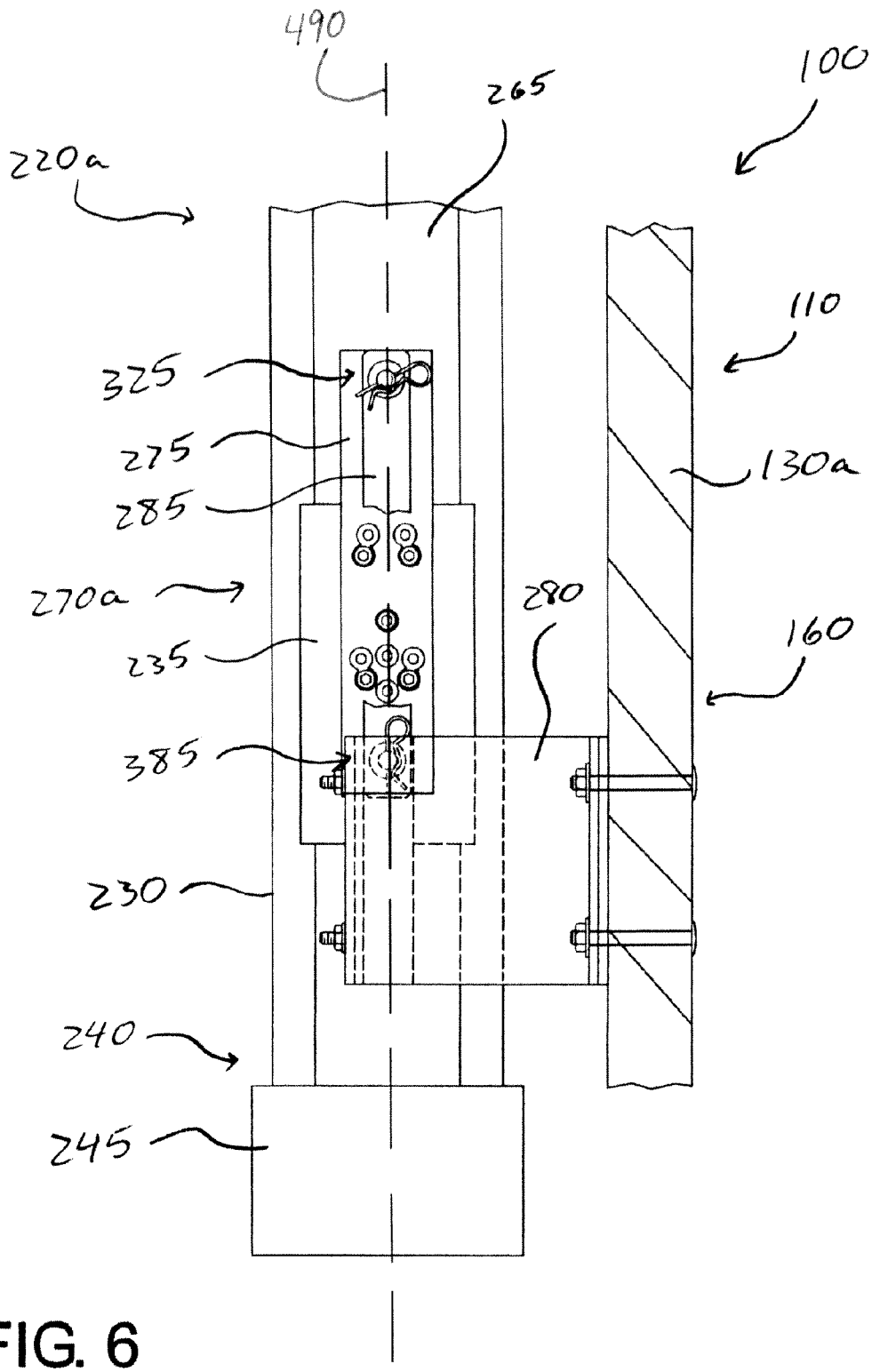
FIG. 6 is a fragmentary cross sectional view of the door and operator of FIG. 3 illustrating the connection between the bracket assembly, the operator assembly and the door according to the present disclosure.

FIG. 3 and FIG. 6 illustrate the bracket assembly securely fastened to both the carriage 235 and the door 110. The first link 275 is securely fastened to the carriage 235 such that the first end 295 extends from the carriage. More particularly, the first pivot joint 325 is positioned in a fixed offset relation to the carriage 235 such that the first pivot joint remains in the same position relative to the carriage as the door 110 is urged to move between the closed position and the open position. Additionally, bracket member 280 has a cantilevered arrangement to allow the transfer of force from the rodless cylinder operators 220*a*, 220*b* to the door while the rollers 182 are engaged within the channel 165 of the track assembly 135. The geometric orientation of the bracket assemblies 270*a*, 270*b* prevents inadvertent contact with the track assembly 135 during actuation.

In one embodiment, the first rodless cylinder operator 220*a* and the second rodless cylinder operator 220*b* are aligned along a common vertical plane 490. This plane is oriented generally perpendicular to the floor 155 and generally parallel to and spaced from the door 110 and/or the opening 125. The piston 243, the carriage 235, the first link 275, the second link 285, and at least the base member 410 of the bracket member 280 are generally aligned along the common vertical plane 490 as the door 110 is maintained in the closed position. Additionally, the first pivot joint 325 and the second pivot joint 385 are generally aligned along a common vertical plane 490 as the door is maintained in the closed position.

As the rodless cylinder operators are actuated by the controller, the door 110 is urged to move between the closed position and the open position. In one embodiment, the piston 243, carriage 235, and the associated bracket assembly 270*a*, 270*b* are simultaneously actuated to linearly translate relative to the elongated body 230 between the first position 225 and second position 227 while maintaining general alignment along the common vertical plane 490. It should be noted that the second link 285, second pivot joint 385 and the bracket assembly 280 are adapted to pivot away from the common vertical plane 490 as the overhead door moves between the closed position and open position.

Figure 5:
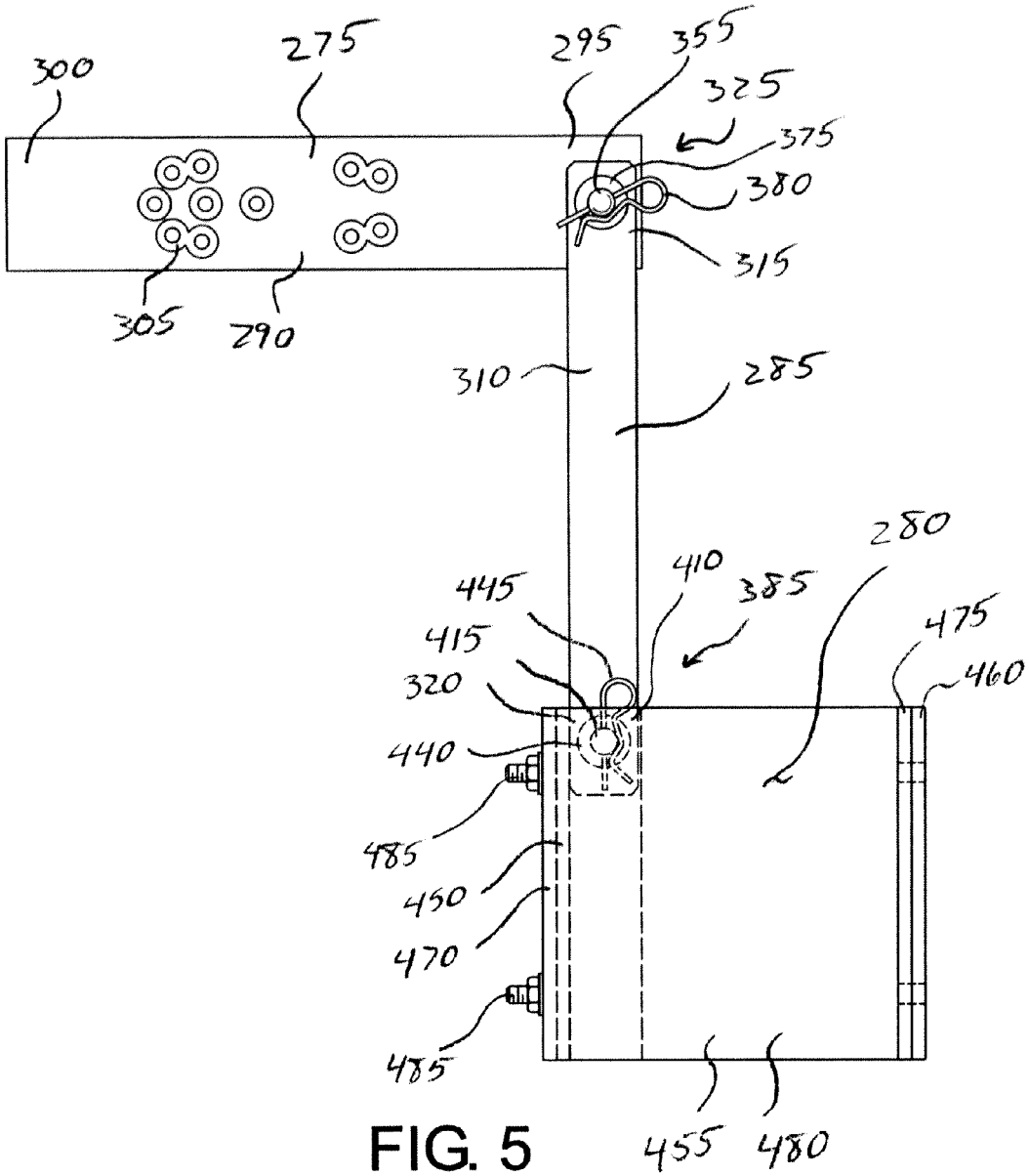
FIG. 5 is an assembled side view of the bracket assembly of FIG. 4.

Thus, the second link 285, second pivot joint 385 and the bracket assembly 280 pivot away from the vertical plane 490 as the first panel 130*a* is urged towards the opened position and the rollers 182 extending from the door are positioned along the non-linear profile 207 of the second portion 205 of the track assembly 135. Notably, FIG. 5 illustrates the bracket assembly in the assembled condition such that the second link 285 is pivoted away from the first link 275. The non-linear profile 207 of the track assembly 135 can be configured in different arrangements. The bracket assembly 280 also includes a degree of motion separate from the first link 275 such that the first panel 130*a* and bracket member 280 are adapted to pivot along the second pivot joint 385 relative to the second link 285.

The present disclosure thus provides a door operator system which minimizes frequent breakdowns, hazard to personnel, and damage to the door. Such a door operator is believed to have an improved life cycle in relation to conventional door operators that include counterbalance mechanisms. More particularly, the disclosed door operator system reduces the risk of corrosion and breakdown in a humid environment with a high usage demand such as in a building used for vehicle washing or other uses.

The exemplary embodiments of the disclosure have been described herein. Obviously, modifications and alterations will occur to others upon reading and understanding the preceding detailed description. It is intended that the instant disclosure be construed as including all such modifications and alterations insofar as they come within the scope of the appended claims or the equivalents thereof.

The invention claimed is:

1. A sliding overhead door operator system for an overhead door not employing a counterbalance mechanism, comprising:

an overhead door including first and second side edges, the door comprising a plurality of hingedly connected longitudinally extending panels;

first and second rodless cylinders, one located adjacent each of the first and second side edges of the door, each cylinder including a carriage;

first and second bracket assemblies, each assembly including a first portion secured to a respective carriage of one of the first and second rodless cylinders and a second portion secured to one of the plurality of panels, wherein the first and second bracket assemblies each include:

a first link secured to the carriage, the first link comprising the first portion of each of the first and second bracket assemblies, a second link pivotally attached to the first link, a bracket member secured to the door and pivotally attached to the second link, the bracket member comprising the second portion of each of the first and second bracket assemblies, wherein the first link is pivotally attached to the second link at a first pivot joint having an axis and the second link is pivotally attached to the bracket member at a second pivot joint having an axis; and a controller adapted to actuate the first and second rodless cylinders to move the door up and down, wherein the first pivot joint axis and the second pivot joint axis align along a common vertical plane when the door is in a closed position and the second pivot joint axis is adapted to pivot away from the common vertical plane when the door is actuated by the controller.

2. The sliding overhead door operator system according to claim 1, wherein the second portion of each bracket assembly is mounted to a bottom panel adjacent a respective one of the first and second side edges.

3. The sliding overhead door operator system according to claim 1, wherein the rodless cylinders are fluid operated rodless cylinders.

4. The sliding overhead door operator system according to claim 1, further comprising fluid lines which are in communication with the first and second rodless cylinders and the controller.

5. A sectional overhead door system not employing a counter balance assembly, the overhead door system comprising:

a track assembly located adjacent to an associated building opening;

a door including a plurality of hingedly connected sectional panels moveably mounted to the track assembly;

a pair of rodless cylinder operators connected to the door, each operator disposed adjacent a respective side edge of the door and including an elongated body, a piston adapted for linear translation within the body, and a carriage connected to the piston and adapted for linear translation externally along a length of the body;

a pair of arm assemblies each adapted to connect a respective one of the pair of rodless cylinder operators to a bottom panel of the door wherein each arm assembly comprises:

a first link having a first end and a second end, the first link being attached to the carriage, a second link having a first end and a second end, the first end of the second link being connected to the first link, a bracket member connected to the second end of the second link and adapted to be attached to the bottom panel of the door, wherein the first link is pivotally attached to the second link at a first pivot joint having an axis and the second link is pivotally attached to the bracket member at a second pivot joint having an axis; and a controller adapted to operate the rodless cylinder operators to move the door between a closed position and an open position in relation to the track assembly, wherein the first pivot joint axis and the second pivot joint axis align along a common vertical plane when the door is in a closed position and the second pivot joint axis is adapted to pivot away from the common vertical plane when the door is actuated by the controller.

6. The overhead door system of claim 5 wherein the first link and the carriage maintain a generally parallel alignment relative to the associated building opening as the door slidingly moves between the first position and the second position.

7. The overhead door system of claim 5 wherein the first link and the carriage maintain a linear translation as the door slidingly moves between the first position and the second position.

8. The overhead door system of claim 5 wherein the track assembly includes a first portion and a second portion, the first portion being oriented generally parallel to and spaced from the associated building opening and the second portion oriented generally transverse to the first portion.

9. The overhead door system of claim 8 wherein a length of the elongated body of the rodless cylinder operator is greater than is a length of the first portion of the track assembly.

10. The overhead door system of claim 5 wherein the controller comprises a pneumatic system including a plurality of lines adapted to convey pressurized air to respective ends of the rodless piston within the elongated body.

11. The overhead door system of claim 5 wherein the piston and carriage are linearly translated between the first position and the second position while being generally aligned along the common vertical plane.

12. An operator system for an overhead door not employing a counterbalance mechanism, comprising:

an overhead door including first and second side edges;

first and second rodless cylinders, one located adjacent each of the first and second side edges of the door, each cylinder including a carriage;

first and second bracket assemblies, each assembly including a first portion secured to a respective carriage of one of the first and second rodless cylinders and a second portion secured to the overhead door wherein the first and second bracket assemblies each include:

a first link secured to the carriage, the first link comprising the first portion of each of the first and second bracket assemblies, a second link pivotally attached to the first link, a bracket member secured to the door and pivotally attached to the second link, the bracket member comprising the second portion of each of the first and second bracket assemblies, wherein the first link is pivotally attached to the second link at a first pivot joint having an axis and the second link is pivotally attached to the bracket member at a second pivot joint having an axis; and a controller adapted to actuate the first and second rodless cylinders to move the door up and down, wherein the first pivot joint axis and the second pivot joint axis align along a common vertical plane when the door is in a closed position and the second pivot joint axis is adapted to pivot away from the common vertical plane when the door is actuated by the controller.

13. The operator system of claim 12 wherein the overhead door comprises a plurality of hingedly connected door panels.

14. The operator system of claim 13, wherein the second portion of each bracket assembly is mounted to a bottom panel of the door adjacent a respective one of the first and second side edges.

15. The operator system of claim 12, wherein the rodless cylinders are fluid operated rodless cylinders.

16. The operator system of claim 15, further comprising fluid lines which are in communication with the first and second rodless cylinders and the controller.

17. The operator system of claim 12 wherein the track assembly includes a first portion and a second portion, the first portion being oriented generally parallel to and spaced from the associated building opening and the second portion being oriented generally transverse to the first portion.

18. The operator system of claim 17 wherein a length of the elongated body of the rodless cylinder operator is greater than is a length of the first portion of the track assembly.

* * * * *